US011742566B2

(12) United States Patent
Hsu et al.

(10) Patent No.: US 11,742,566 B2
(45) Date of Patent: Aug. 29, 2023

(54) ANTENNA STRUCTURE AND MOBILE DEVICE INCLUDING THE SAME

(71) Applicant: WISTRON NEWEB CORPORATION, Hsinchu (TW)

(72) Inventors: Yuan-Chia Hsu, Hsinchu (TW); Chin-Lung Yeh, Hsinchu (TW); Wei-Shin Chen, Hsinchu (TW)

(73) Assignee: WISTRON NEWEB CORPORATION, Hsinchu (TW)

( * ) Notice: Subject to any disclaimer, the term of this patent is extended or adjusted under 35 U.S.C. 154(b) by 49 days.

(21) Appl. No.: 17/691,155

(22) Filed: Mar. 10, 2022

(65) Prior Publication Data

US 2023/0110612 A1 Apr. 13, 2023

(30) Foreign Application Priority Data

Oct. 13, 2021 (TW) ..... 110137875

(51) Int. Cl.

| | |
|---|---|
| ***H01Q 1/24*** | (2006.01) |
| ***H01Q 1/48*** | (2006.01) |
| ***H01Q 5/371*** | (2015.01) |
| ***H01Q 5/378*** | (2015.01) |
| ***H01Q 5/321*** | (2015.01) |

(52) U.S. Cl.

CPC ..... *H01Q 1/243* (2013.01); *H01Q 1/48* (2013.01); *H01Q 5/321* (2015.01); *H01Q 5/371* (2015.01); *H01Q 5/378* (2015.01)

(58) Field of Classification Search

CPC ..... H01Q 1/243; H01Q 5/321; H01Q 5/378; H01Q 1/48

See application file for complete search history.

*Primary Examiner* — Graham P Smith

(74) *Attorney, Agent, or Firm* — McClure, Qualey & Rodack, LLP

(57) ABSTRACT

An antenna structure and a mobile device including the same are provided. The antenna structure is arranged on a metal cover with an opening slot, and includes a radiator, a feeding part, a grounding element, a grounding parasitic element, an extending parasitic element, a substrate, and a matching circuit. The radiator extends along a first direction, and the feeding part is connected to the radiator and extends towards a second direction. The grounding parasitic element includes a branch part and a parasitic element body. The branch part extends from a grounding point towards the opening slot. The parasitic element body is connected to the grounding element through the branch part and extends towards a first direction. The extending parasitic element extends along the first direction. The matching circuit is electrically connected to the radiator, the grounding element, the grounding parasitic element, and the extending parasitic element.

9 Claims, 6 Drawing Sheets

ANTENNA STRUCTURE AND MOBILE DEVICE INCLUDING THE SAME

CROSS-REFERENCE TO RELATED PATENT APPLICATION

This application claims the benefit of priority to Taiwan Patent Application No. 110137875, filed on Oct. 13, 2021. The entire content of the above identified application is incorporated herein by reference.

Some references, which may include patents, patent applications and various publications, may be cited and discussed in the description of this disclosure. The citation and/or discussion of such references is provided merely to clarify the description of the present disclosure and is not an admission that any such reference is "prior art" to the disclosure described herein. All references cited and discussed in this specification are incorporated herein by reference in their entireties and to the same extent as if each reference was individually incorporated by reference.

FIELD OF THE DISCLOSURE

The present disclosure relates to an antenna structure and a mobile device including the same, and more particularly to an antenna structure and a mobile device including the same capable of realizing miniaturization.

BACKGROUND OF THE DISCLOSURE

Electronic devices such as notebook computers are usually provided with wireless antennas covering various frequency bands, such as LTE/5G, Bluetooth 2.4 GHz, WI-FI 2.4 GHz, 5 GHz, 6G and other frequency bands. A single electronic device that supports mobile communication networks of the above-mentioned multiple frequency bands is usually realized by using several different antennas.

For the benefit of antenna performance, an antenna is usually placed at a periphery of a screen or a keyboard. However, since most products nowadays are required to achieve a light, thin, and narrow frame or metal body that are used as a style feature of a high-end product, antenna design can be difficult, and the efficiency thereof may be reduced.

SUMMARY OF THE DISCLOSURE

In response to the above-referenced technical inadequacies, the present disclosure provides an antenna structure and a mobile device including the same capable of realizing miniaturization.

In one aspect, the present disclosure provides an antenna structure arranged on a metal cover, the metal cover has an opening slot, the opening slot has an open end and a closed end arranged along a first direction, and a first side and a second side arranged along a second direction, and the first direction is perpendicular to the second direction. The antenna structure includes a radiator, a feeding part, a grounding element, a grounding parasitic element, an extending parasitic element, a substrate, and a matching circuit. The radiator covers a position where the metal cover is adjacent to the closed end, and extends from the closed end to the open end along the first direction to cover a position where the opening slot is adjacent to the first side. The feeding part is connected to the radiator, and extends from a side of the radiator adjacent to the closed end towards the second direction to cover a position where the metal cover is adjacent to the closed end and a position where the opening slot is adjacent to the closed end. A feeding point is disposed in the feeding part. The grounding element is connected to the metal cover. The ground parasitic element includes a branch part and a parasitic element body. The branch part extends from the ground point on the ground member toward the opening slot to cover the first part of the opening slot. The parasitic element body is connected to the grounding element through the branch part and extends from one side of the branch part towards the first direction to cover a second portion of the opening slot. The parasitic body is disposed between the radiator and the grounding element. The extending parasitic element is separated from the parasitic element body by a first distance and extending along the first direction, and is arranged between the radiator and the grounding element. The feeding part, the grounding element, the grounding parasitic element and the extending parasitic element are disposed on the substrate. The matching circuit includes a first reactance element, a second reactance element, and a first inductive reactance element. The first reactance element is electrically connected between the parasitic element body and the radiator, the second reactance element is electrically connected between the parasitic element body and the grounding element, and the first inductive reactance element is electrically connected between the parasitic element body and the extending parasitic element.

In another aspect, the present disclosure provides a mobile device including a metal cover and an antenna structure. The metal cover has an opening slot. The opening slot has an open end and a closed end arranged along a first direction, and a first side and a second side arranged along a second direction, and the first direction is perpendicular to the second direction. The antenna structure is arranged on the metal cover and includes a radiator, a feeding part, a grounding element, a grounding parasitic element, an extending parasitic element, a substrate and a matching circuit. The radiator covers a position where the metal cover is adjacent to the closed end, and extends from the closed end to the open end along the first direction to cover a position where the opening slot is adjacent to the first side. The feeding part is connected to the radiator, and extends from a side of the radiator adjacent to the closed end towards the second direction to cover a position where the metal cover is adjacent to the closed end and a position where the opening slot is adjacent to the closed end. A feeding point is disposed in the feeding part. The grounding element is connected to the metal cover. The ground parasitic element includes a branch part and a parasitic element body. The branch part extends from the ground point on the ground member toward the opening slot to cover the first part of the opening slot. The parasitic element body is connected to the grounding element through the branch part and extends from one side of the branch part towards the first direction to cover a second portion of the opening slot. The parasitic body is disposed between the radiator and the grounding element. The extending parasitic element is separated from the parasitic element body by a first distance and extending along the first direction, and is arranged between the radiator and the grounding element. The feeding part, the grounding element, the grounding parasitic element and the extending parasitic element are disposed on the substrate. The matching circuit includes a first reactance element, a second reactance element, and a first inductive reactance element. The first reactance element is electrically connected between the parasitic element body and the radiator, the second reactance element is electrically connected between the parasitic element body and the grounding element, and the first inductive reactance element is electrically connected between the parasitic element body and the extending parasitic element.

Therefore, the antenna structure and the mobile device including the same provided by the present disclosure can use the grounding parasitic element to provide an additional return path to the grounding element, generate additional resonance frequencies, and adjust a length of the radiator, a distance between the grounding parasitic element and the radiator, and a distance between the grounding parasitic element and the grounding element, so as to manage antenna characteristics.

In addition, the antenna structure and the mobile device including the same provided by the present disclosure are further provided with the grounding parasitic element to provide space for disposing the matching circuit, and form the matching circuit by using a combination of one or more levels of reactance elements and inductive reactance elements, so as to further improve an adjustable range of the antenna characteristics, thereby realizing a miniaturized antenna structure under limited substrate space.

These and other aspects of the present disclosure will become apparent from the following description of the embodiment taken in conjunction with the following drawings and their captions, although variations and modifications therein may be affected without departing from the spirit and scope of the novel concepts of the disclosure.

BRIEF DESCRIPTION OF THE DRAWINGS

The described embodiments may be better understood by reference to the following description and the accompanying drawings, in which.

DETAILED DESCRIPTION OF THE EXEMPLARY EMBODIMENTS

Figure 1:
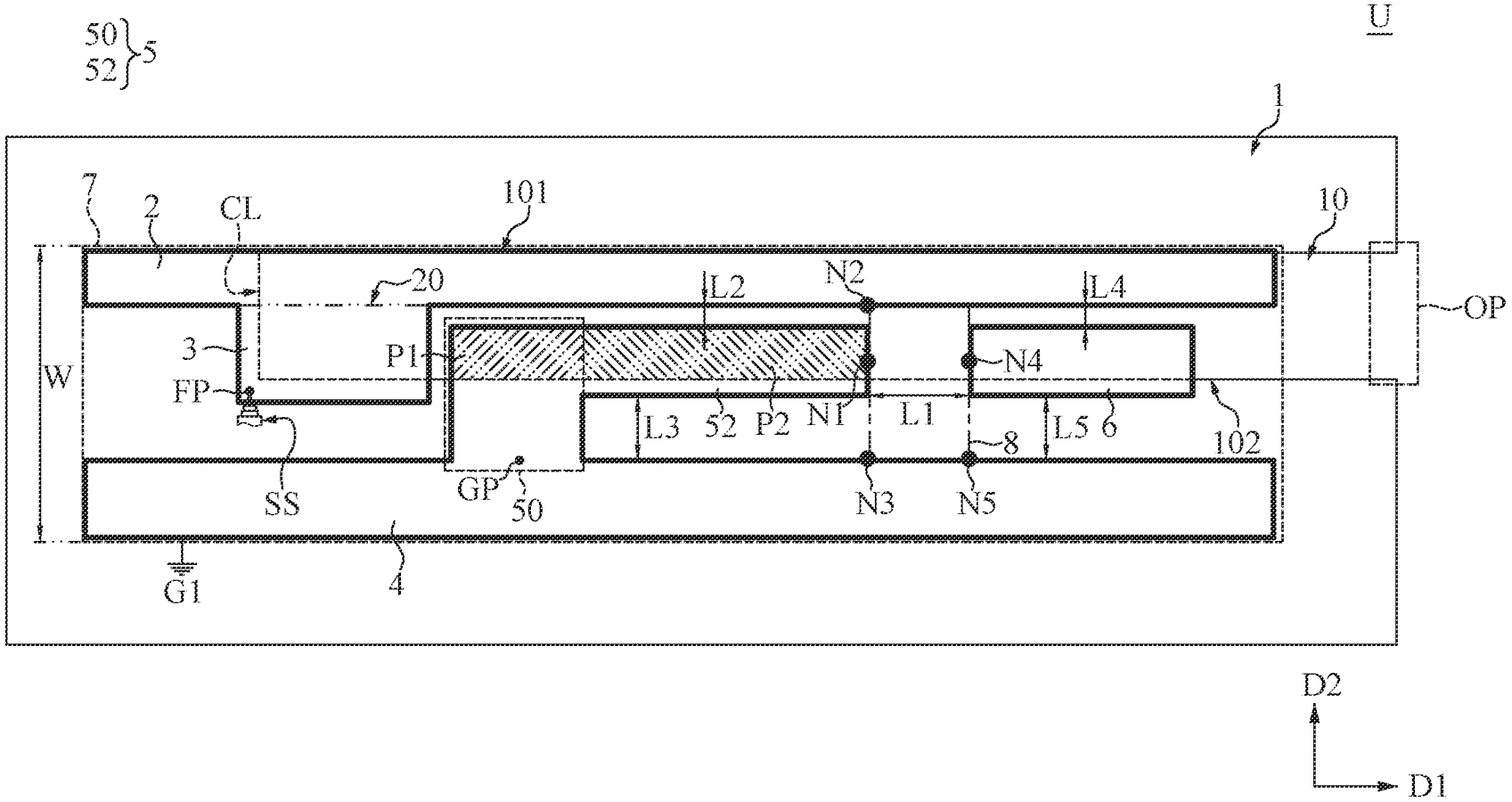
FIG. 1 is a schematic top view of an antenna structure according to one embodiment of the present disclosure.

The present disclosure is more particularly described in the following examples that are intended as illustrative only since numerous modifications and variations therein will be apparent to those skilled in the art. Like numbers in the drawings indicate like components throughout the views. As used in the description herein and throughout the claims that follow, unless the context clearly dictates otherwise, the meaning of "a", "an", and "the" includes plural reference, and the meaning of "in" includes "in" and "on". Titles or subtitles can be used herein for the convenience of a reader, which shall have no influence on the scope of the present disclosure.

The terms used herein generally have their ordinary meanings in the art. In the case of conflict, the present document, including any definitions given herein, will prevail. The same thing can be expressed in more than one way. Alternative language and synonyms can be used for any term(s) discussed herein, and no special significance is to be placed upon whether a term is elaborated or discussed herein. A recital of one or more synonyms does not exclude the use of other synonyms. The use of examples anywhere in this specification including examples of any terms is illustrative only, and in no way limits the scope and meaning of the present disclosure or of any exemplified term. Likewise, the present disclosure is not limited to various embodiments given herein. Numbering terms such as "first", "second" or "third" can be used to describe various components, signals or the like, which are for distinguishing one component/signal from another one only, and are not intended to, nor should be construed to impose any substantive limitations on the components, signals or the like.

FIG. 1 is a schematic top view of an antenna structure according to one embodiment of the present disclosure. Referring to FIG. 1, one embodiment of the present disclosure provides an antenna structure U, which is arranged on a metal cover 1. The antenna structure U includes a radiator 2, a feeding part 3, a grounding element 4, a grounding parasitic element 5, an extending parasitic element 6, a substrate 7 and a matching circuit 8. The radiator 2, the feeding part 3, the grounding element 4, the grounding parasitic element 5, and the extending parasitic element 6 can all be made of metal materials, such as copper, silver, aluminum, iron, or their alloys. In order to avoid visual obscuration and allow for easier understanding of the present disclosure, in FIG. 1, the substrate 7 is shown as a transparent element. The substrate 7 can be a flame retardant 4 (FR4) substrate, a printed circuit board (PCB), or a flexible circuit board (FCB). The substrate 7 is arranged on the metal cover 1, and the radiator 2, the feeding part 3, the grounding element 4, the grounding parasitic element 5, the extending parasitic element 6 and the matching circuit 8 are all arranged on the substrate 7.

Figure 2:
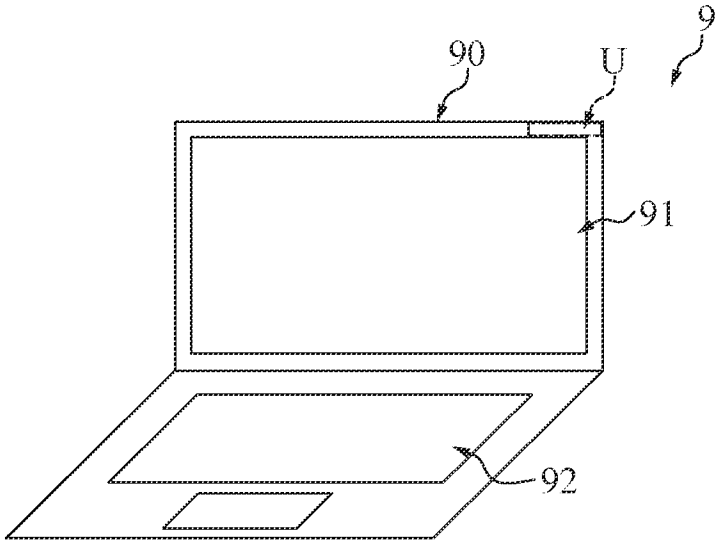
FIG. 2 is a schematic diagram showing a configuration of a mobile device and an antenna structure thereof according to one embodiment of the present disclosure.

FIG. 2 is a schematic diagram showing a configuration of a mobile device and an antenna structure thereof according to one embodiment of the present disclosure. Referring to FIG. 2, the metal cover 1 can be a metal shell for a mobile device 9. In some embodiments, the mobile device 9 is a notebook computer, and the metal cover 1 is a metal upper cover 90 of the notebook computer. The antenna structure U is placed around a screen 91 or around a keyboard 92. However, the present disclosure is not limited thereto. The mobile device 9 and the metal cover 1 can also be, for example, a tablet computer and a metal cover thereof. As shown in FIG. 1, the metal cover 1 has an opening slot 10. The opening slot 10 has an open end OP and a closed end CL arranged along a first direction D1, a first side 101 and a second side 102 arranged along a second direction D2, and the first direction D1 is perpendicular to the second direction D2. The antenna structure U can also include a non-conducting material, which is used to fill the opening slot 10.

The radiator 2 covers a position where the metal cover 1 is adjacent to the closed end CL, and extends from the closed end CL to the open end OP along the first direction D1 to cover a position where the opening slot 10 is adjacent to the first side 101. In more detail, the radiator 2 covers a part of the metal cover 1 adjacent to the closed end CL and close to the first side 101, in which the radiator 2 extends from the closed end CL to the open end OP, so as to at least partially overlap with the opening slot 10 in the first direction D1.

Further referring to FIG. 1, the feeding part 3 is connected to the radiator 2, and extends from a side of the radiator 2 adjacent to the closed end CL in the second direction D2 to cover a position where the metal cover 1 is adjacent to the closed end CL and a position where the opening slot 10 is adjacent to the closed end CL. In other words, the feeding part 3 covers a part of the metal cover 1 adjacent to the closed end CL and the second side 102, and also covers a part of the opening slot 10 adjacent to the closed end CL and the second side 102.

In addition, a feeding point FP is further disposed in the feeding part 3. In some embodiments, the feeding point FP can overlap with the part of the metal cover 1 covered by the feeding part 3. In one preferred embodiment, the feeding point FP is arranged at a corner adjacent to the closed end CL and the second side 102. In detail, the feeding part 3 is a position where the signal source SS feeds in, and energy enters from the feeding point FP, such that the radiator 2 and the opening slot 10 can be coupled to resonate to generate radiation energy of a required frequency band.

The grounding member 4 is coupled to a ground potential G1 and resonates with the radiator 2. For example, the grounding element 4 can be coupled to the ground potential G1 by connecting the metal cover 1. In a conventional design for an antenna, the radiator 2 is used to generate resonance, and a distance between the radiator 2 and the ground member 4 is then used to control the antenna characteristics. However, adjustable ranges of the antenna characteristics are constrained by a spatial limitation of the substrate 7.

Therefore, under this limitation, the present disclosure provides a grounding parasitic 5 between the radiator 2 (together with the feeding part 3) and the grounding element 4 to adjust the characteristics of the antenna. Further, the grounding parasitic element 5 includes a branch part 50 and a parasitic element body 52. The branch part 50 extends from a grounding point GP on the grounding element 4 towards the opening slot 10 to cover a first portion P1 of the opening slot 10.

The parasitic element body 52 is connected to the grounding element 4 through the branch part 50 and extends from one side of the branch part 50 in the first direction D1 to a first node N1 to cover a second portion P2 of the opening slot 10. The parasitic element body 52 is disposed between the radiator 2 and the grounding element 4, and the radiator 2 and the grounding element 4 can, for example, respectively have a second node N2 and a third node N3 corresponding to the first node N1 in the second direction D2. In addition, the parasitic element body 52 is separated from the radiator 2 and the ground element 4 by a distance L2 and a distance L3, respectively. In the embodiment of the present disclosure, the parasitic element body 52, the radiator 2 and the ground element 4 are parallel to each other, but the present disclosure is not limited thereto.

Therefore, in a structure using the grounding parasitic element 5, the grounding parasitic element 5 can be used to provide an additional return path to the grounding element 4 to generate an additional resonance frequency, and a length of the radiator 2 in the first direction D1, a distance L2 and a distance L3 can be adjusted to control the antenna characteristics.

However, due to space constraints, a space of the substrate 7 that can be used by the antenna structure U is limited. Therefore, required antenna characteristics may not sufficient to be obtained even if the grounding parasitic element 5 is used for adjustment. For example, a width of the opening slot 10 in the first direction D1 can be 20 mm, a length of the opening slot 10 in the second direction D2 can be 2 mm, and a width W of the substrate 7 in the first direction D1 can be 20 mm, and a length of the substrate 7 in the second direction can be 4 mm. In such a limited space, the present disclosure further provides an extending parasitic element 6 to provide space for arranging the matching circuit 8 so as to improve the adjustable range of the antenna characteristics.

Further referring to FIG. 1, the extending parasitic element 6 is separated from the parasitic element body 52 by a distance L1, extends along the first direction D1, and is disposed between the radiator 2 and the grounding element 4. The extending parasitic element 6 has a fourth node N4 facing the first node N1. In the embodiment of the present disclosure, the feeding part 3, the parasitic element body 52, and the extending parasitic element 6 are sequentially arranged along the first direction D1.

The extending parasitic element 6 can be regarded as a frame extending from the parasitic element body 52 along a virtual extension line in the first direction D1. Therefore, a width of the extending parasitic element 6 in the second direction D2 can be the same as the width of the parasitic element body 52 in the second direction D2, and the extending parasitic element 6 is parallel to the parasitic element body 52.

Therefore, in certain embodiments, the extending parasitic element 6 can be separated from the radiator 2 and the grounding element 4 by a distance L4 and a distance L5, respectively, the distance L2 can be equal to the distance L4, and the distance L3 can be equal to the distance L5. Furthermore, in this embodiment, the distance L3 can be greater than the distance L2, and the distance L5 can be greater than the distance L4. In addition, the distance L2, the distance L3, the distance L4, and the distance L5 can be in the range of 0.05 to 0.25 times the width W of the substrate 7, and is limited by a processing capability in the manufacturing of two metal microstrip lines on the PCB.

The matching circuit 8 can be electrically connected to the first node N1, the second node N2, the third node N3, and the fourth node N4. The matching circuit 8 can be a combination of one or more levels of reactance elements and inductive reactance elements, and can be implemented in series or in parallel.

Figure 3B:
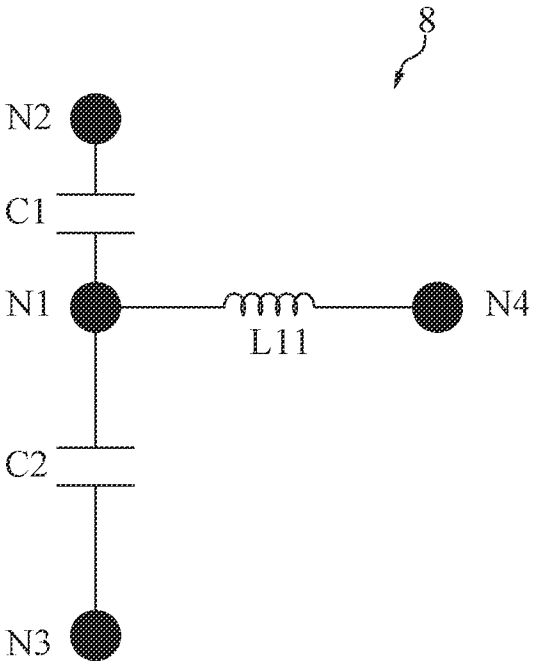
FIGS. 3A and 3B are a first circuit diagram and a second circuit diagram of a matching circuit according to one embodiment of the present disclosure.
Figure 3A:
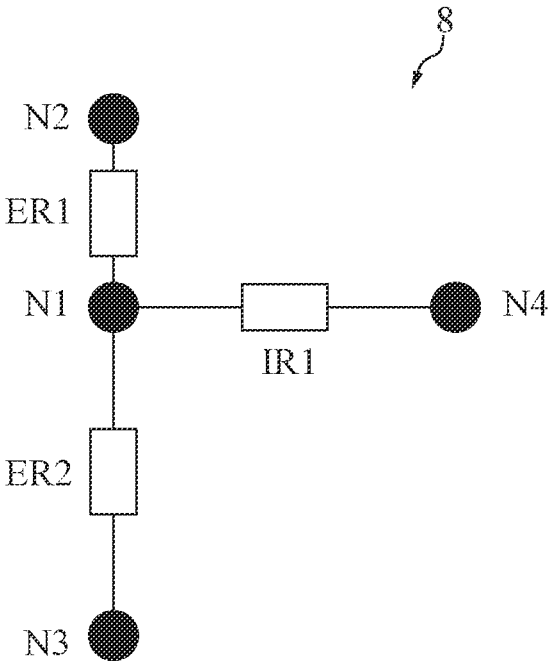

Reference can be further made to FIGS. 3A and 3B, which are a first circuit diagram and a second circuit diagram of a matching circuit according to one embodiment of the present disclosure. As shown in FIG. 3A, the matching circuit 8 can include a first reactance element ER1, a second reactance element ER2, and a first inductive reactance element IR1. The first reactance element ER1 is electrically connected between the parasitic element main body 52 and the radiator 2, for example, and can be electrically connected between the first node N1 and the second node N2. The second reactance element ER2 is electrically connected between the parasitic element body 52 and the grounding element 4, for example, and can be electrically connected between the first node N1 and the third node N3. The first inductive reactance element IR1 is electrically connected between the parasitic element body 52 and the extending parasitic element 6, for example, and can be electrically connected between the first node N1 and the fourth node N4. The reactance elements can be capacitors, and the inductive reactance elements are usually inductors.

Figure 4:
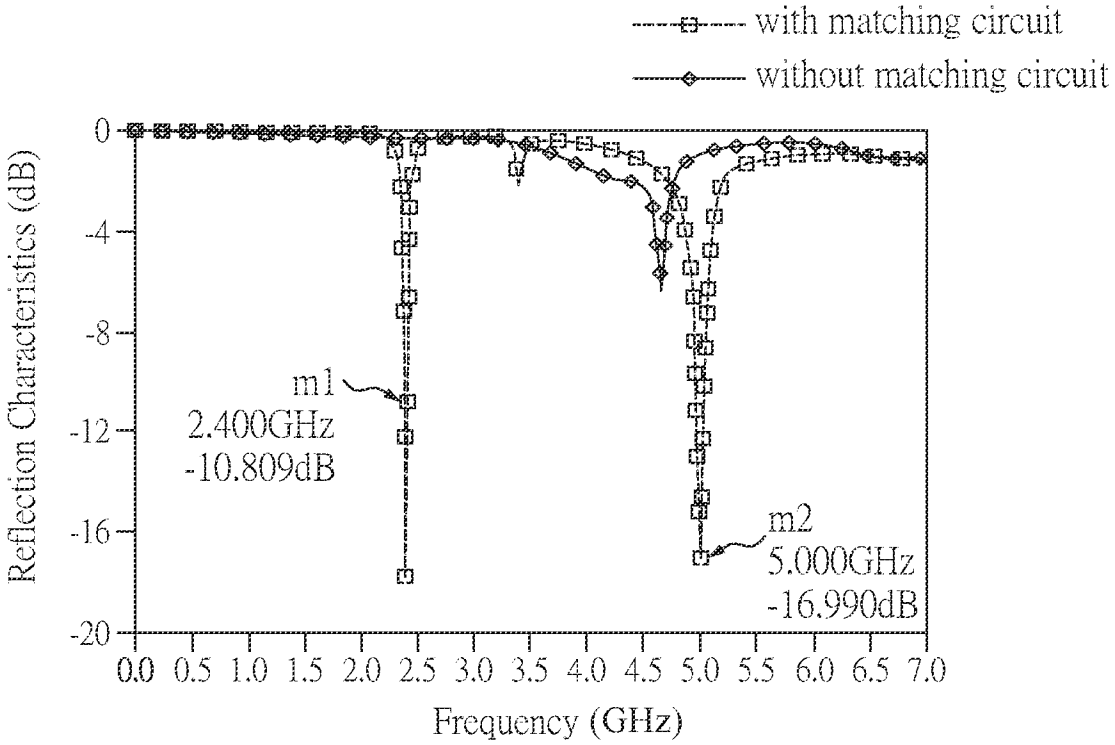
FIG. 4 is a graph of reflection characteristics of an antenna structure with and without a matching circuit according to one embodiment of the present disclosure.

For example, as shown in FIG. 3B, in a specific embodiment of the present disclosure, the first reactance element ER1 is a capacitor C1, the second reactance element ER2 is a capacitor C2, and the first inductive reactance element IR1 is an inductor L11. Reference can be further made to FIG. 4, which is a graph of reflection characteristics of an antenna structure with and without a matching circuit according to one embodiment of the present disclosure. In FIG. 4, a capacitance of the capacitor C1 being 3.9 pF, a capacitance of the capacitor C2 being 2 pF, and an inductance of the inductor L11 being 2 nH serve as conditions for setting up the matching circuit 8 of FIGS. 1 and 3B, and reflection characteristics are measured (labeled as matching circuit in FIG. 4) as an experimental group, which is then compared with a control group that has the same structure without the matching circuit. From data points m1 and m2 in FIG. 4, it can be seen that the reflection characteristics of the experimental group with the matching circuit at WI-FI 2.4 GHz and 5 GHz are less than −10 dB, which is significantly better than the reflection characteristics of the control group without the matching circuit. Therefore, a miniaturized Wi-Fi 2.4 GHz and 5 GHz dual-band antenna can be realized through the above architecture.

Figure 5:
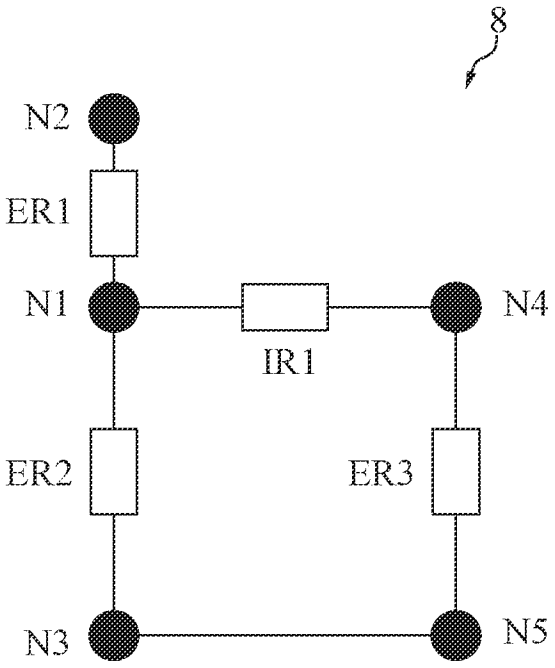
FIG. 5 is a third circuit diagram of a matching circuit according to one embodiment of the present disclosure.

Reference can be further made to FIG. 5, which is a third circuit diagram of a matching circuit according to one embodiment of the present disclosure. In the embodiment of FIG. 5, the matching circuit 8 further includes a third reactance element ER3 connected between the fourth node N4 and the grounding element 4. In more detail, referring to FIG. 1, the grounding element 4 further includes a fifth node N5, the fifth node N5 is electrically connected to the third node N3, and the third reactance element ER3 can be connected to the extending parasitic element 6 and the grounding element 4, for example, and can be connected between the fourth node N4 and the fifth node N5.

Therefore, similar to FIG. 3B, in response to the first reactance element ER1, the second reactance element ER2, and the third reactance element ER3 being capacitors or inductors, and the first inductive reactance element IR1 being an inductor, the antenna characteristics can be adjusted according to practical requirements under a premise that adjustable ranges of the antenna characteristics are improved.

Figure 6:
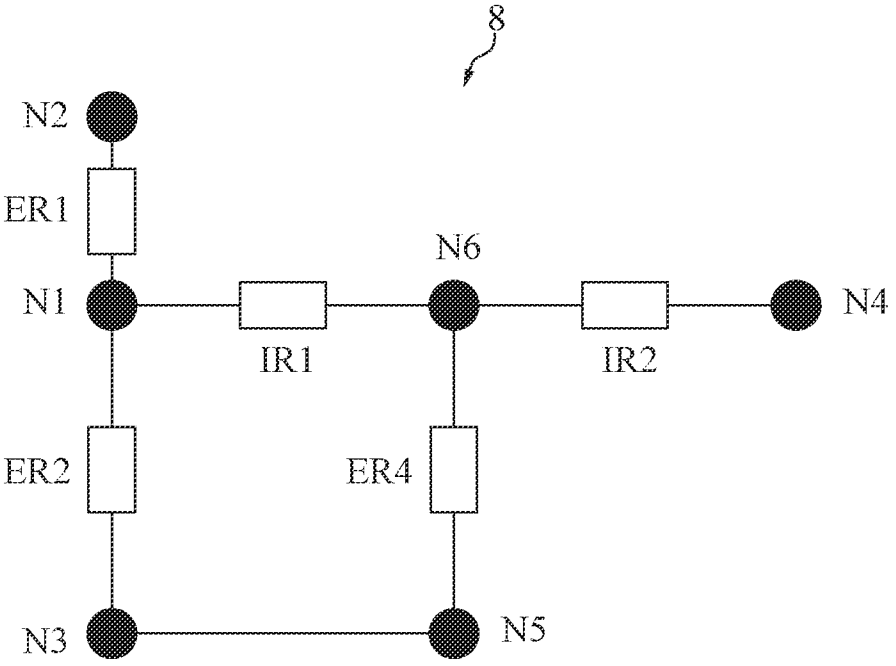
FIG. 6 is a fourth circuit diagram of the matching circuit according to one embodiment of the present disclosure.

Reference can be further made to FIG. 6, which is a fourth circuit diagram of the matching circuit according to one embodiment of the present disclosure. In the embodiment of FIG. 6, the matching circuit 8 further includes a second inductive reactance element IR2 and a fourth reactance element ER4. The second inductive reactance element IR2 can be connected between the first inductive reactance element IR1 and the extending parasitic element 6, for example, and can be connected between the first inductive reactance element IR1 and the fourth node N4. The fourth reactance element ER4 has one end that can be connected to the first inductive reactance element IR1 and the second inductive reactance element IR2, and has another end that can be connected to the grounding element 4. For example, the fourth reactance element ER4 can be connected between the sixth node N6 and the fifth node N5. The sixth node N6 is located between the first inductive reactance element IR1 and the second inductive reactance element IR2.

In the embodiment of FIG. 6, the matching circuit 8 is a combination of multi-level reactance elements and inductive reactance elements, and is implemented in a form of parallel connections. Therefore, similar to FIG. 3B, in response to the first reactance element ER1, the second reactance element ER2, and the fourth reactance element ER4 being capacitors, and the first inductive reactance element IR1 and the second inductive reactance element IR2 being inductors, the antenna characteristics can be adjusted according to requirements under a premise that adjustable ranges of the antenna characteristics are improved. In the embodiments of FIG. 5 and FIG. 6, the matching circuit can increase a bandwidth of an operating frequency band, and the bandwidth increases as an order of levels of the matching circuit increases.

In conclusion, the antenna structure and the mobile device including the same provided by the present disclosure can use the grounding parasitic element to provide an additional return path to the grounding element, generate additional resonance frequencies, and adjust a length of the radiator, a distance between the grounding parasitic element and the radiator, and a distance between the grounding parasitic element and the grounding element, so as to manage antenna characteristics.

In addition, the antenna structure and the mobile device including the same provided by the present disclosure are further provided with the grounding parasitic element to provide space for disposing the matching circuit, and form the matching circuit by using a combination of one or more levels of reactance elements and inductive reactance elements, so as to further improve an adjustable range of the antenna characteristics, thereby realizing a miniaturized antenna structure under a limited substrate space.

The foregoing description of the exemplary embodiments of the disclosure has been presented only for the purposes of illustration and description and is not intended to be exhaustive or to limit the disclosure to the precise forms disclosed. Many modifications and variations are possible in light of the above teaching.

The embodiments were chosen and described in order to explain the principles of the disclosure and their practical application so as to enable others skilled in the art to utilize the disclosure and various embodiments and with various modifications as are suited to the particular use contemplated. Alternative embodiments will become apparent to those skilled in the art to which the present disclosure pertains without departing from its spirit and scope.

What is claimed is:

1. An antenna structure, arranged on a metal cover, wherein the metal cover has an opening slot, the opening slot has an open end and a closed end arranged along a first direction, and a first side and a second side arranged along a second direction, and the first direction is perpendicular to the second direction, the antenna structure comprising:

a radiator covering a position where the metal cover is adjacent to the closed end, and extending from the closed end to the open end along the first direction to cover a position where the opening slot is adjacent to the first side;

a feeding part connected to the radiator, and extending from a side of the radiator adjacent to the closed end towards the second direction to cover a position where the metal cover is adjacent to the closed end and a position where the opening slot is adjacent to the closed end, wherein, a feeding point is disposed in the feeding part;

a grounding element connected to the metal cover;

a grounding parasitic element, including:

a branch part extending from a grounding point on the grounding element towards the opening slot to cover a first portion of the opening slot; and a parasitic element body connected to the grounding element through the branch part and extending from one side of the branch part towards the first direction to cover a second portion of the opening slot, wherein the parasitic element body is disposed between the radiator and the grounding element;

an extending parasitic element separated from the parasitic element body by a first distance and extending along the first direction, and arranged between the radiator and the grounding element;

a substrate, wherein the feeding part, the grounding element, the grounding parasitic element and the extending parasitic element are disposed on the substrate; and a matching circuit, including:

a first reactance element electrically connected between the parasitic element body and the radiator;

a second reactance element electrically connected between the parasitic element body and the grounding element; and a first inductive reactance element electrically connected between the parasitic element body and the extending parasitic element.

2. The antenna structure according to claim 1, wherein the parasitic element body is separated from the radiator and the grounding element by a second distance and a third distance, respectively, and the extending parasitic element is separated from the radiator and the grounding element by a fourth distance and a fifth distance, respectively.

3. The antenna structure according to claim 2, wherein the second distance is equal to the fourth distance, and the third distance is equal to the fifth distance.

4. The antenna structure according to claim 2, wherein the third distance is greater than the second distance, and the fifth distance is greater than the fourth distance.

5. The antenna structure according to claim 1, wherein the feeding part, the parasitic element body and the extending parasitic element are arranged in sequence along the first direction.

6. A mobile device, comprising:

a metal cover having an opening slot, wherein the opening slot has an open end and a closed end arranged along a first direction, and a first side and a second side arranged along a second direction, and the first direction is perpendicular to the second direction; and an antenna structure arranged on the metal cover and including:

a radiator covering a position where the metal cover is adjacent to the closed end, and extending from the closed end to the open end along the first direction to cover a position where the opening slot is adjacent to the first side;

a feeding part connected to the radiator, and extending from a side of the radiator adjacent to the closed end towards the second direction to cover a position where the metal cover is adjacent to the closed end and a position where the opening slot is adjacent to the closed end, wherein a feeding point is disposed in the feeding part;

a grounding element connected to the metal cover;

a grounding parasitic element, including:

a branch part extending from a grounding point on the grounding element towards the opening slot to cover a first portion of the opening slot; and a parasitic element body connected to the grounding element through the branch part and extending from one side of the branch part towards the first direction to cover a second portion of the opening slot, wherein the parasitic element body is disposed between the radiator and the grounding element;

an extending parasitic element separated from the parasitic element body by a first distance and extending along the first direction, and arranged between the radiator and the grounding element;

a substrate, wherein the feeding part, the grounding element, the grounding parasitic element and the extending parasitic element are disposed on the substrate;

a matching circuit, including:

a first reactance element electrically connected between the parasitic element body and the radiator;

a second reactance element electrically connected between the parasitic element body and the grounding element; and a first inductive reactance element electrically connected between the parasitic element body and the extending parasitic element.

7. The mobile device according to claim 6, wherein the first reactance element is a first capacitor, the second reactance element is a second capacitor, and the first inductive reactance element is a first inductor.

8. The mobile device according to claim 6, wherein the matching circuit further includes a third reactance element connected between the extending parasitic element and the grounding element.

9. The mobile device according to claim 6, wherein the matching circuit further includes:

a second inductive reactance element connected between the first inductive reactance element and the extending parasitic element; and a fourth reactance element having one end connected to the first inductive reactance element and the second inductive reactance element, and another end connected to the grounding element.

* * * * *